US005166581A

United States Patent [19]

Chermin et al.

[11] Patent Number: 5,166,581

[45] Date of Patent: Nov. 24, 1992

[54] DISCHARGE LAMP IGNITOR WHICH ADJUSTS THE AMPLITUDE OF IGNITION PULSES

[75] Inventors: Hubertus M. J. Chermin, Eindhoven; Egbert Van Zanten, Grave, both of Netherlands

[73] Assignee: U.S. Philips Corporation, New York, N.Y.

[21] Appl. No.: 751,374

[22] Filed: Aug. 28, 1991

[30] Foreign Application Priority Data

Sep. 12, 1990 [NL] Netherlands ..... 9002006

[51] Int. Cl.[5] ..... H05B 41/00

[52] U.S. Cl. ..... 315/289; 315/307; 315/DIG. 5

[58] Field of Search ..... 315/289, 291, 307, DIG. 5

[56] References Cited

U.S. PATENT DOCUMENTS

| | | | |
|---|---|---|---|
| 3,519,881 | 7/1970 | Engel et al. . | |
| 3,944,876 | 3/1976 | Helmuth | 315/289 X |
| 4,247,803 | 1/1981 | Walz | 315/289 |
| 5,051,665 | 9/1991 | Garrison et al. | 315/289 X |

*Primary Examiner*—Robert J. Pascal

*Attorney, Agent, or Firm*—Edward Blocker

[57] ABSTRACT

An ignitor circuit for a gas discharge lamp includes a transformer and means for generating pulsatory voltages across a primary winding of the transformer to generate ignition pulses by means of a secondary winding of the transformer. The ignitor circuit further includes first means for measuring an amplitude of the ignition pulses, and second means for changing the pulsatory voltage across the primary winding, and thus changing the amplitude of the ignition pulses, in dependence on the measured amplitude of the ignition pulses. The ignitor circuit is capable of generating a suitable ignition pulse over a wide range of connection cable lengths.

18 Claims, 2 Drawing Sheets

DISCHARGE LAMP IGNITOR WHICH ADJUSTS THE AMPLITUDE OF IGNITION PULSES

BACKGROUND OF THE INVENTION

The invention relates to a circuit arrangement suitable for igniting a lamp and comprising a transformer and means for generating pulsatory voltages across a primary winding of the transformer in order to generate ignition pulses by means of a secondary winding of the transformer.

Such a circuit arrangement is known from the German Patent Application 2011663 laid open to public inspection. The circuit described therein is suitable for connection to an AC voltage source and comprises means by which it can be detected whether a connected lamp has or has not ignited. If it is detected after connection to an AC voltage source that the connected lamp has not ignited, an ignition pulse is generated by the circuit arrangement every half cycle of the AC voltage. This ignition pulse has an amplitude which is a multiple of the AC voltage amplitude. A lamp can be efficiently and reliably ignited by means of the known circuit arrangement.

If the known circuit arrangement is connected to the lamp by means of comparatively short connection cables, the amplitude of the ignition pulse generated by the circuit arrangement is hardly influenced by the capacitance of the connection cables. In practice, however, it is often not possible to choose the connection cables to be short. Under such circumstances, the circuit arrangement and the lamp are interconnected by means of comparatively long connection cables. The comparatively long connection cables represent a considerable capacitance, which adversely affects the amplitude of the ignition pulse.

It is generally valid that the amplitude of the ignition pulse should at least have a minimum value, which depends on the lamp, in order to ignite a lamp. The use of ignition pulses having an amplitude which is considerably greater than the required minimum value, however, is undesirable because this adversely affects the life of the lamp and of the ballast circuit coupled to the lamp. Therefore, it is desirable to choose the amplitude of the ignition pulse within comparatively narrow limits.

Since the amplitude of the ignition pulse is to a high degree dependent on the capacitance presented by the connection cables, it is necessary to dimension the known circuit arrangement in dependence on the length and type of the connection cables which will serve as the connection. This implies that different circuit arrangements must be dimensioned for the ignition of one type of lamp, each circuit arrangement being suitable only for use within a restricted range of connection cable lengths between the circuit arrangement and the lamp. This range depends on the type of connection cable which is used.

SUMMARY OF THE INVENTION

The invention has for its object inter alia to provide a measure by which the dimensioning of the circuit arrangement is to a large extent independent of the length and type of the connection cables between the circuit arrangement and the lamp.

According to the invention, a circuit arrangement of the kind described in the opening paragraph is for this purpose characterized in that the circuit arrangement is additionally provided with first means for measuring an amplitude of the ignition pulses, and second means for changing the pulsatory voltage across the primary winding, and thus changing the amplitude of the ignition pulses, in dependence on the measured amplitude of the ignition pulses.

When the circuit arrangement is connected to a voltage supply source, the first means measure the amplitude of the generated ignition pulse during the ignition phase. If this amplitude is lower than the required minimum value, the second means change the pulsatory voltages across the primary winding of the transformer in such a way that the amplitude of the ignition pulses increases as a result. Thus it is made possible to generate a pulsatory ignition voltage with an amplitude suitable for the lamp both with the use of short connection cables and with the use of long connection cables in one circuit arrangement.

An advantageous embodiment of a circuit arrangement according to the invention is characterized in that the means for generating pulsatory voltages across the primary winding of the transformer comprise first capacitive means, and in that the second means comprise adjustment means for adjusting a capacitance of the first capacitive means, which adjustment means are coupled to the first means.

In such a circuit arrangement, an increase in the capacitance of the capacitive means results in an increase in the pulse width of the pulsatory voltages across the primary winding. Consequently, the amplitude of the ignition pulses increases. The means for generating pulsatory voltages across the primary winding of the transformer and the second means have thus been realised in a simple and reliable manner.

Another advantageous embodiment of a circuit arrangement according to the invention is characterized in that the first means comprise a voltage divider, which includes a voltage-dependent resistor, and shunt means including further capacitive means and a diode, for shunting a portion of the voltage divider.

In this embodiment of the circuit arrangement, the voltage divider shunts the lamp during operation. The voltage-dependent resistor is so chosen that the resistive voltage divider passes current substantially exclusively during an ignition pulse. During the ignition phase the further capacitive means are charged up to a voltage which is proportional to the amplitude of the ignition pulses. The diode ensures that a premature discharge of the second capacitive means is counteracted. Thus the first means for measuring an amplitude of the ignition pulses have been realised in a simple and reliable manner.

A further embodiment of a circuit arrangement according to the invention is characterized in that the circuit arrangement is provided with means for adjusting a minimum value for the amplitude of the ignition pulse.

The adjustment possibility of a desired minimum value achieves that the circuit arrangement is suitable for use in combination with lamps of widely differing power ratings and types.

BRIEF DESCRIPTION OF THE DRAWINGS

Embodiments of a circuit arrangement according to the invention will be explained in more detail with reference to a drawing.

In the drawing

DESCRIPTION OF THE PREFERRED EMBODIMENTS

Figure 1:
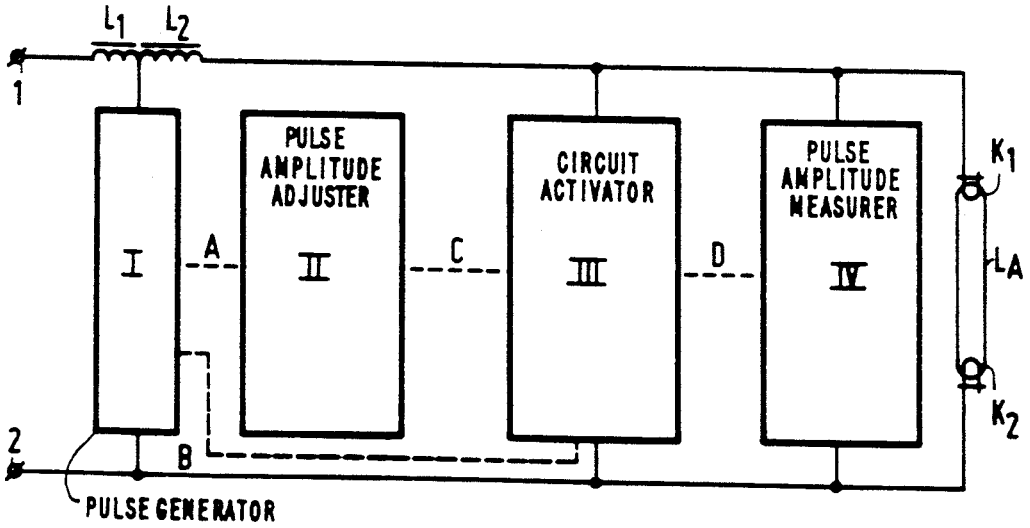
FIG. 1 shows diagrammatically the construction of a circuit arrangement according to the invention.

In FIG. 1, reference numerals 1 and 2 denote input terminals suitable for being connected to poles of a voltage supply source. Primary winding L1 and secondary winding L2 together form a transformer. Circuit I consists of means for generating a pulsatory voltage across primary winding L1. For this purpose, circuit I is connected both to a common point of primary winding L1 and secondary winding L2 and to the input terminal 2.

Circuit II forms further means for changing the pulsatory voltage across the primary winding and thus changing the amplitude of the ignition pulses. Circuit II is for that purpose linked to circuit I. This link is represented in FIG. 1 by means of broken line A. Circuit IV consists of first means for measuring an amplitude of the ignition pulses. For this purpose, circuit IV is linked to lamp connection terminals K1 and K2. A lamp La can be connected to lamp connection terminals K1 and K2. Circuit III is a circuit section for activating circuit I and, depending on the amplitude of the ignition pulse, circuit II. Circuit III is for this purpose linked to the circuits I, II and IV. These links are indicated with broken lines B, C and D.

The operation of the circuit arrangement shown in FIG. 1 is as follows.

When the input terminals 1 and 2 are connected to the poles of a voltage supply source and the lamp is not ignited, circuit III activates circuit I, so that a pulsatory voltage is generated across primary winding L1. This pulsatory voltage is transformed up by the transformer to form ignition pulses. The amplitude of these ignition pulses is measured by circuit IV. If the amplitude is below a minimum value, circuit III activates circuit II. Circuit II then raises the amplitude of the ignition pulses.

After ignition of the lamp, primary winding L1 and secondary winding L2 function as a ballast for stabilizing the lamp current.

Figure 2:
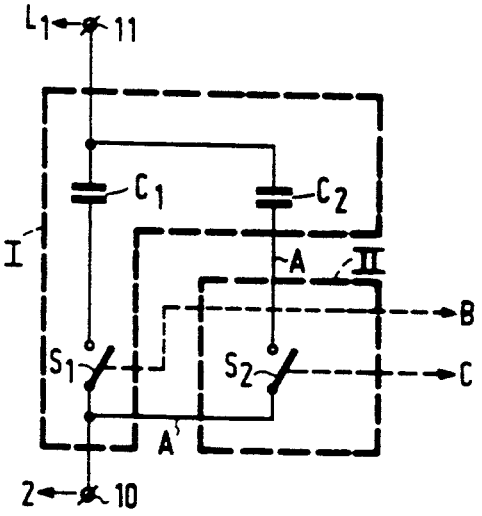
FIGS. 2, 3 and 4 each show a portion of the circuit arrangement of FIG. 1 in greater detail.

FIG. 2 shows an embodiment of circuit I and circuit II. Capacitors C1 and C2 form first capacitive means and switching element S2 forms adjustment means for adjusting the capacitance of the first capacitive means. Circuit I in this embodiment comprises a branch formed by a series circuit of a capacitor C1 and a switching element S1. Reference numerals 10 and 11 denote ends of the branch. The branch connects input terminal 2 to an end of primary winding L1 remote from input terminal 1. A first end of capacitor C2 is connected to a first end of capacitor C1. A further end of capacitor C2 is connected to circuit II. If the switching element S1 has been made conducting by circuit III, a supply voltage provided by the supply voltage source causes oscillatory voltages across primary winding L1 and capacitor C1. The switching element S1 becomes non-conducting when the current in the branch is zero, so that the oscillatory voltage across primary winding L1 is present during a half cycle only, so that it is pulsatory. Circuit II in this embodiment consists of the switching element S2. If the switching element S2 is conducting, it forms a connection between the further end of capacitor C2 and input terminal 2. If the ignition pulse is lower than the required minimum value, circuit III renders the two switching elements S1 and S2 conducting substantially simultaneously, so that capacitor C2 is connected in parallel to capacitor C1. As a result, the capacitance of the first capacitive means increases from the capacitance of capacitor C1 to the sum of the capacitances of capacitor C1 and capacitor C2. The frequency of the oscillatory voltage across primary winding L1 is thus lower than in the case in which switching element S2 is non-conducting. The pulse duration of the ignition pulse consequently increases. Since the impedance formed by the parasitic capacitance of the connection cables by which the lamp is connected to the circuit arrangement increases in proportion as the pulse duration increases, the amplitude of the ignition pulse also increases with an increase in the pulse duration.

Obviously, it is possible to shunt the capacitive means with further branches comprising a capacitance and a switching element. If the switching elements of an increasing number of further branches are made conducting, it is possible to increase the amplitude of the ignition pulse in steps and to bring it to a desired value for the lamp used. The range of connection cable lengths of a certain type between the circuit arrangement and the lamp over which the circuit arrangement is capable of igniting the lamp is also further increased by this.

Figure 3:
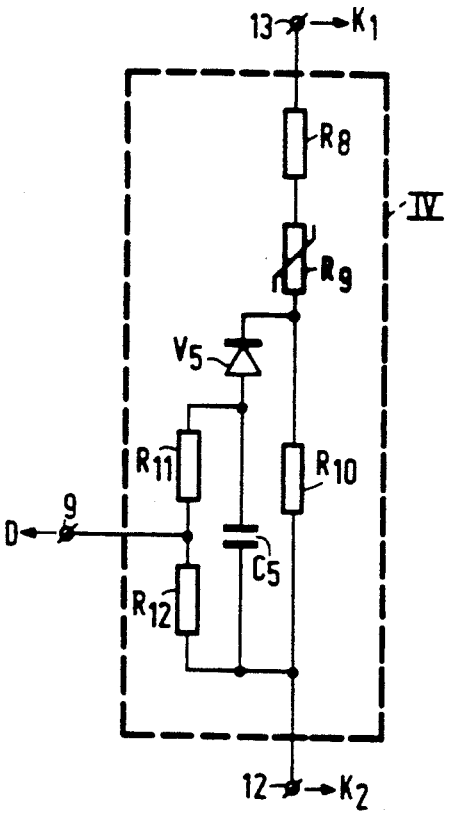

FIG. 3 shows an embodiment of circuit IV for measuring the ignition pulse amplitude. In FIG. 3, resistors R8 and R10 and voltage-dependent resistor R9 form a resistive voltage divider. If this embodiment of circuit arrangement IV is used, ends 12 and 13 of the resistive voltage divider are connected to lamp connection terminals K1 and K2. The resistive voltage divider passes current substantially exclusively during an ignition pulse thanks to a suitable choice of the voltage-dependent resistor R9. Resistor R10 is shunted by a series circuit of a capacitor C5 and a diode V5 in such a way that a cathode of diode V5 is connected to a common point of resistor R10 and voltage-dependent resistor R9. After an ignition pulse of such a polarity that the capacitor C5 conducts current during the pulsatory ignition pulse, the capacitor C5 is charged up to a voltage which is proportional to the amplitude of the ignition pulse. Capacitor C5 is shunted by a resistive voltage divider consisting of resistors R11 and R12. Output terminal 9 is connected to a common point of resistor R11 and resistor R12, so that a voltage is present at output terminal 9 proportional to the voltage across capacitor C5, and thus also proportional to the ignition pulse amplitude. If, for example, resistor R11 and/or resistor R12 are/is made adjustable, the required minimum amplitude of the ignition pulse can be made adjustable. This adjustment possibility for the required minimum value of the ignition pulse amplitude may also be achieved by choosing a variable resistor for resistor R8 and/or resistor R10.

Figure 4:
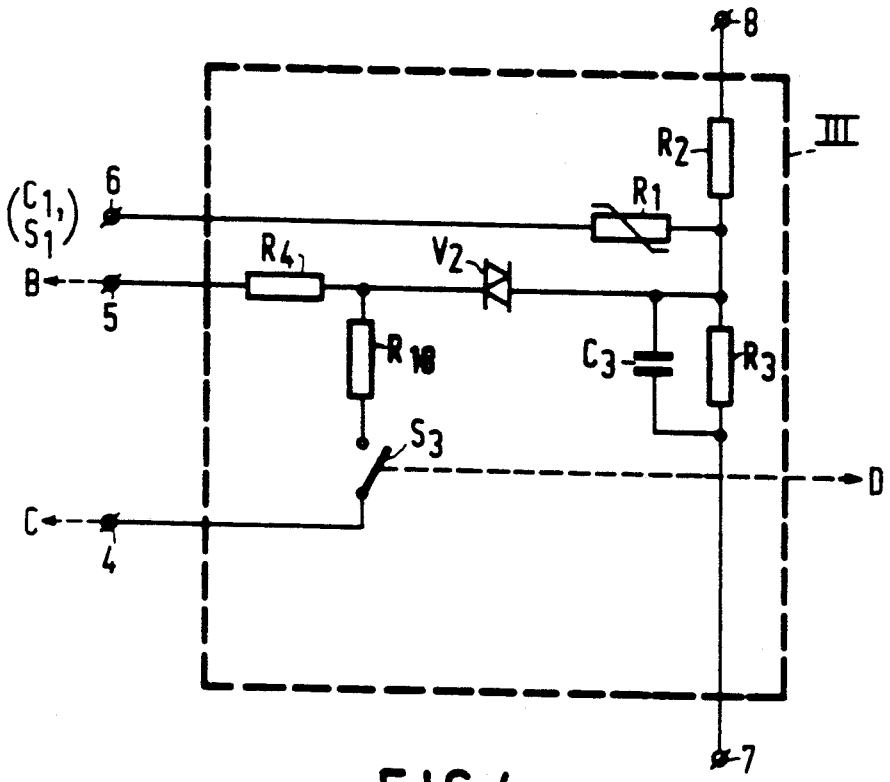

FIG. 4 shows an embodiment of circuit III. In FIG. 4, resistors R2 and R3 form a resistive voltage divider having ends 7 and 8. Resistor R3 is shunted by capacitor C3, and a common point of resistor R2 and resistor R3 is connected to a series circuit of a breakdown element V2, resistor R4, and output terminal 5. A common point of resistor R4 and breakdown element V2 is connected to a series circuit of resistor R18, switching element S3, and output terminal 4. The common point of resistor R2 and resistor R3 is connected to a series circuit of voltage-dependent resistor R1 and input terminal 6.

If this embodiment of circuit III is used in combination with the embodiments of the circuits I, II and IV shown in FIGS. 2 and 3, ends 7 and 8 are connected to input terminal 2 and an end of secondary winding L2 remote from the common point of primary winding L1 and secondary winding L2, respectively. Output terminal 5 and output teminal 4 are connected to a control electrode of switching element S1 and a control electrode of switching element S2, respectively. A control electrode of switching element S3 is coupled to an output terminal 9 of circuit IV. Input terminal 6 is connected to a common point of capacitor C1 and switching element S1.

The operation of this embodiment of circuit III is as follows.

When input terminals 1 and 2 are connected to poles of an AC voltage source, capacitor C3 is charged up to a voltage at which the breakdown element V2 becomes conducting every half cycle of an AC voltage supplied by the AC voltage source. This renders the switching element S1 conducting via resistor R4, so that an ignition pulse is generated. If the amplitude of the ignition pulse is lower than the required minimum value, switching element S3 is made conducting via the output of circuit IV. If breakdown element V2 becomes conducting again in the next half cycle of the AC voltage, both switching element S1 and switching element S2 are made condcuting by this, which results in an increase in the ignition pulse amplitude.

If the lamp La connected to the lamp connection terminals K1 and K2 ignites, the amplitude of the voltage between the two ends 7 and 8 drops to such a level that the voltage across capacitor C3 no longer reaches the value at which the breakdown element V2 becomes conducting, so that no further ignition pulses are generated.

Voltage-dependent resistor R1 serves to limit the voltage across capacitor C1.

Figure 5:
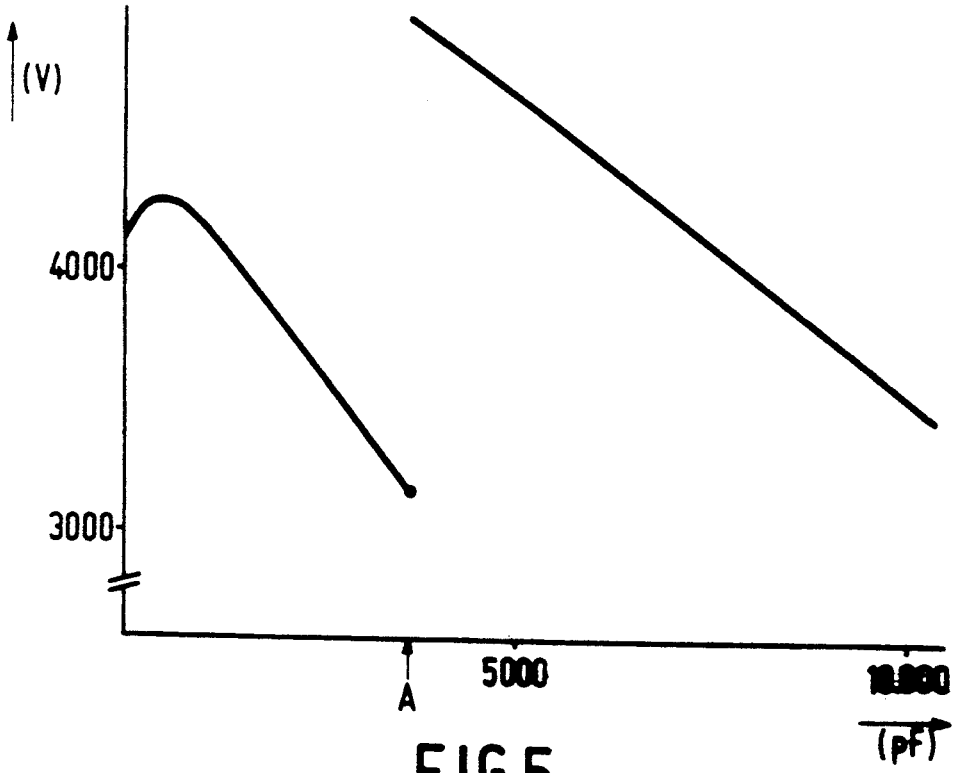
FIG. 5 is a graph representing the amplitude of a pulsatory ignition voltage generated by means of a practical embodiment of a circuit arrangement according to the invention as a function of the parasitic capacitance of connection cables which link the circuit arrangement to a lamp.

In FIG. 5, the parasitic capacitance of the connection cables Cka is plotted in pF on the horizontal axis. The amplitude of the pulsatory ignition voltage is plotted in V on the vertical axis. It can be seen in the Figure that the circuit arrangement supplies an ignition pulse whose amplitude is in excess of 4000 Volts in the case of short connection cables. When the parasitic capacitance Cka of the connection cables has increased to more than 3600 pF (point A in FIG. 5), the amplitude of the ignition pulse is only just above 3100 Volts. When the parasitic capacitance of the connection cables increases still further, the capacitor C2 is connected in parallel to the capacitor C1, so that the amplitude of the ignition pulses increases and remains greater than 3100 Volts, even when the parasitic capacitance of the connection cables has increased to 11,000 pF.

The parasitic capacitance of the cable used was approximately 200 pF per meter. It can be derived from FIG. 5 that the measure according to the invention leads to an increase in the connection cable length range over which the circuit arrangement generates a suitable ignition pulse has increased from approximately 0--18 meters to approximately 0-55 meters.

We claim:

1. An ignitor circuit for igniting a gas discharge lamp, said circuit comprising:

pulse generating means for generating pulsatory voltages;

amplifying means for amplifying the pulsatory voltages from said pulse generating means to ignition pulses for the discharge lamp;

first, measuring means for measuring the amplitude of the ignition pulses from said amplifying means; and second means for changing the pulsatory voltages from said pulse generating means for changing the amplitude of the ignition pulses from said amplifying means in dependence on the amplitude of the ignition pulses measured by said measuring means.

2. An ignitor circuit as claimed in claim 1, wherein said pulse generating means comprises first capacitive means, and said second means comprises adjustment means coupled to said first means for adjusting a capacitance of the first capacitive means.

3. An ignitor circuit as claimed in claim 2, wherein said adjustment means modifies the pulsatory voltages for increasing the amplitude of the ignition pulses when the amplitude of the ignition pulses measured by said measuring means is below a predetermined minimum value, and said ignitor further comprises means for adjusting said predetermined minimum value.

4. An ignitor circuit as claimed in claim 2, wherein said measuring means comprises a voltage divider having a voltage-dependent resistor, and shunt means, including further capacitive means and a diode, for shunting a portion of said voltage divider.

5. An ignitor circuit as claimed in claim 4, wherein said adjustment means modifies said pulsatory voltages for increasing the amplitude of the ignition pulses when the amplitude of the ignition pulses measured by said measuring means is below a predetermined minimum value, and said ignitor further comprises means for adjusting said predetermined minimum value.

6. An ignitor circuit as claimed in claim 1, wherein said adjustment means modifies the pulsatory voltages for increasing the amplitude of the ignition pulses when the amplitude of said ignition pulses measured by said measuring means is below a predetermined minimum value, and said ignitor further comprises means for adjusting said predetermined minimum value.

7. An ignitor circuit as claimed in claim 1, wherein said measuring means comprises a voltage divider having a voltage-dependent resistor, and shunt means, including further capacitive means and a diode, for shunting a portion of said voltage divider.

8. An ignitor circuit as claimed in claim 7, wherein said adjustment means modifies said pulsatory voltages for increasing the amplitude of the ignition pulses when the amplitude of the ignition pulses measured by said measuring means is below a predetermined minimum value, and said ignitor further comprises means for adjusting said predetermined minimum value.

9. An ignitor circuit according to claim 1, wherein said amplifying means is comprised by a transformer having a primary and a secondary winding.

10. An ignitor circuit according to claim 9, wherein said pulse generating means comprises first capacitive means, and said second means comprises adjustment means coupled to said first means for adjusting a capacitance of the first capacitive means.

11. An ignitor circuit according to claim 10, wherein said measuring means comprise a voltage divider having a voltage-dependent resistor, and shunt means, including further capacitive means and a diode, for shunting a portion of said voltage divider.

12. An ignitor circuit according to claim 11, wherein said second means increases the pulse width of said pulsatory voltages from said pulse generating means if the ignition pulses have an amplitude below a predetermined minimum value, and said ignitor circuit further comprises means for adjusting the value of said predetermined minimum value.

13. An ignitor circuit according to claim 12, wherein said measuring means comprise a voltage divider having a voltage-dependent resistor, and shunt means, including further capacitive means and a diode, for shunting a portion of said voltage divider.

14. An ignitor circuit for operation with a transformer connected to a gas discharge lamp, said ignitor comprising:

pulse generating means for generating voltage pulses of a predetermined pulse width for application to the transformer, the transformer amplifying the voltage pulses into ignition pulses for the discharge lamp;

first, measuring means for measuring the ignition pulses from the transformer; and second means coupled to said measuring means and pulse generating means for increasing the pulse width of said voltage pulses from said pulse generating means if the ignition pulses measured by said measuring means have an amplitude below a predetermined minimum value.

15. An ignitor circuit according to claim 14, wherein said pulse generating means comprises first capacitive means, and said second means comprises adjustment means coupled to said first means for adjusting a capacitance of the first capacitive means.

16. An ignitor circuit according to claim 15, wherein said measuring means comprise a voltage divider having a voltage-dependent resistor, and shunt means, including further capacitive means and a diode, for shunting a portion of said voltage divider.

17. An ignitor circuit according to claim 16, further comprising means for adjusting the value of said predetermined minimum value.

18. An ignitor circuit according to claim 17, wherein said measuring means comprise a voltage divider having a voltage-dependent resistor, and shunt means, including further capacitive means and a diode, for shunting a portion of said voltage divider.

* * * * *